United States Patent [19]

Miller et al.

[11] 4,104,894

[45] Aug. 8, 1978

[54] PADLOCK HAVING WEDGE DEVICE FOR RESISTING DESTRUCTIVE WEDGE ATTACK

[75] Inventors: James Clayton Miller; Paul R. Proefrock, both of Nicholasville, Ky.

[73] Assignee: Sargent & Greenleaf, Inc., Nicholasville, Ky.

[21] Appl. No.: 839,458

[22] Filed: Oct. 3, 1977

[51] Int. Cl.[2] ..... E05B 67/02; E05C 19/08

[52] U.S. Cl. ..... 70/52; 70/417; 292/281

[58] Field of Search ..... 70/51, 52, 53, 54, 55, 70/56; 292/281, 282, 283, 284, 285, 286, 342, 343

[56] References Cited

U.S. PATENT DOCUMENTS

| | | | |
|---|---|---|---|
| 3,638,460 | 2/1972 | Berry | 70/52 |
| 3,759,557 | 9/1973 | Athas | 292/281 |
| 3,858,923 | 1/1975 | Bunn | 292/281 |

*Primary Examiner*—Robert L. Wolfe

*Attorney, Agent, or Firm*—Mason, Fenwick & Lawrence

[57] ABSTRACT

A high security padlock for use with a pair of companion locking bars having apertured hasp end portions to be disposed in aligned abutment and locked together, the padlock comprising a padlock body having a rearwardly opening cavity to receive the aligned abutting hasp end portions therein and the padlock including a shackle extending through said cavity to pass through a pair of aligned apertures in the hasp end portions, and a lock mechanism with the padlock body, together with a wedge attack resisting saddle wedge device shaped to surround three sides of the pair of aligned hasp end portions having a portion disposed in the rearwardly opening cavity of the lock body and portions protruding rearwardly beyond the rear surface of the lock body. The saddle wedge device has ramp surfaces along one side thereof coactive with inclined cam surfaces of the cavity to impart a component of lateral movement to the device when an attack wedge-like tool is driven against the rear of the lock body into engagement with rearwardly projecting end portions of the device and cause surfaces of the device and of the cavity to tightly grip the hasp end portions against withdrawal.

15 Claims, 9 Drawing Figures

PADLOCK HAVING WEDGE DEVICE FOR RESISTING DESTRUCTIVE WEDGE ATTACK

BACKGROUND AND SUMMARY OF THE INVENTION

The present invention relates in general to high security lock devices for use with paired adjacent staple formations of locking bars or so-called hasps, one or both of which may be L-shaped flange bars, whereby the adjacent alined staple formations receive a locking bolt or shackle therethrough and are shrouded or surrounded forwardly and laterally by the lock device for protection against attack by persons seeking unauthorized forced opening of the locking assembly.

The conventional type of padlock previously used with hasp and staple assemblies for locking doors, security containers and the like have usually included a U-shaped shackle formed of a pair of spaced parallel straight legs joined by a curved intermediate portion, together with a padlock body provided with a key lock plug or combination locking mechanism and bolt means within the padlock body for interlocking with grooves or notches in the shackle leg portions which extend into shackle sockets or openings in the padlock body. In the locked position, the U-shaped shackle normally projects in exposed upstanding relation from the padlock body and is thus exposed to attack by cutting instruments or other burglary tools. In many applications where padlocks have been previously used, the padlock was in an exposed environment where it was not under constant supervision by security personnel, watchmen, or people charged with protecting the area in which the lock was located. In such exposed or unsupervised padlock situations, a person seeking unauthorized entry into the space secured by the padlock had the opportunity to open the lock by any of a number of conventional techniques, such as picking, rapping, sawing, or forcing the padlock open by inserting a wedge type tool between the hasp members and padlock body or shackle to wedge or chisel the lock open.

In recent years, much effort has been devoted to improving lock security for the doors or closures in such exposed situations, by providing a pair of steel plate locking bar members having staple, loop or apertured flange formations, for example a pair of locking bars or L-shaped steel flange plates or straight hasp plates, each having a foot or base portion to be fastened by tamper-resisting screws to adjacent mounting surface portions of a pair of doors, or of a door and door jamb or comparable surface with the plates each providing an integral outwardly projecting apertured staple or loop formation to be disposed in mated or laterally alined relation and secured by a hardened high security padlock shackle. To further improve security, the number of pin tumblers or levers employed in the key cylinder or key locking plug of such padlocks has been increased and the key cylinder made to resist drilling, picking and similar attack techniques. To protect the shackle against attack from the sides and from all directions by sophisticated cutting instruments, hardened padlock bodies have been developed having shroud formations which shield the sides and front of the shackle from attack by cutting instruments.

In some of such locks, the shackle is completely recessed in the padlock body in locked position and the shackle recess has a rearwardly opening slot to receive the pair of outwardly projecting flat apertured flange or staple formations of the locking bars with the padlock shackle passed through the apertures in the flange or staple formations interfitted into the rearwardly opening recess of the lock body. Examples of padlocks of the shrouded type and of other lock devices designed for use with similar locking bars are found in prior U.S. Pat. Nos. 3,652,114 to Cady, 3,759,557 to Athas, 3,769,821 and 3,817,062 to Randel, 3,858,923 to Bunn, 3,901,058 and 3,996,774 to Best, 3,744,280 to Brown and 3,638,460 to Berry. FIG. 8 of U.S. Pat. No. 3,710,603 and FIG. 10 of U.S. Pat. No. 3,713,309 to Miller, both assigned to the assignee of the present application, also show shrouded shackle padlocks with a cruciform shaped recess in the upper end portion of the padlock body opening rearwardly to receive the laterally juxtaposed forwardly projecting apertured legs or end flanges of such locking bars.

A particular problem with these L-shaped flange type locking bars secured by padlock or enshrouding lock devices has been the ability of burglars or unauthorized persons to force the lock off of the locking bars by driving a wedge down between the rear portion of the lock body and the locking bars and thereby tear the shackle forwardly through the flange or staple portion of the locking bars and thereby destroy the holding action of the lock on the locking bars.

An object of the present invention is the provision of a novel anti-wedge shackle lock construction for use with L-shaped flange type locking bars or the like constructed with a wedge type attack resisting device so that attack on the lock mechanism with wedges to attempt to force it off the apertured flange portions will further increase binding action of the lock mechanism components on the apertured flange portions as the wedges are driven, providing additional strength and support to the locking bar flanges and shackle.

Yet another object of the present invention is the provision of a novel shackle type locking device of the concealed shackle or shrouded shackle type adapted for use with L-shaped flange type locking bars and the like, wherein progressively tighter grasping or binding against the flange portions is achieved responsive to movement of a wedge relative to the lock body during attempted forced entry by wedge attack.

Other objects, advantages and capabilities of the present invention will become apparent from the following detailed description, taken in conjunction with the accompanying drawings illustrating a preferred embodiment of the invention.

DETAILED DESCRIPTION OF PREFERRED EMBODIMENTS

Figure 1:
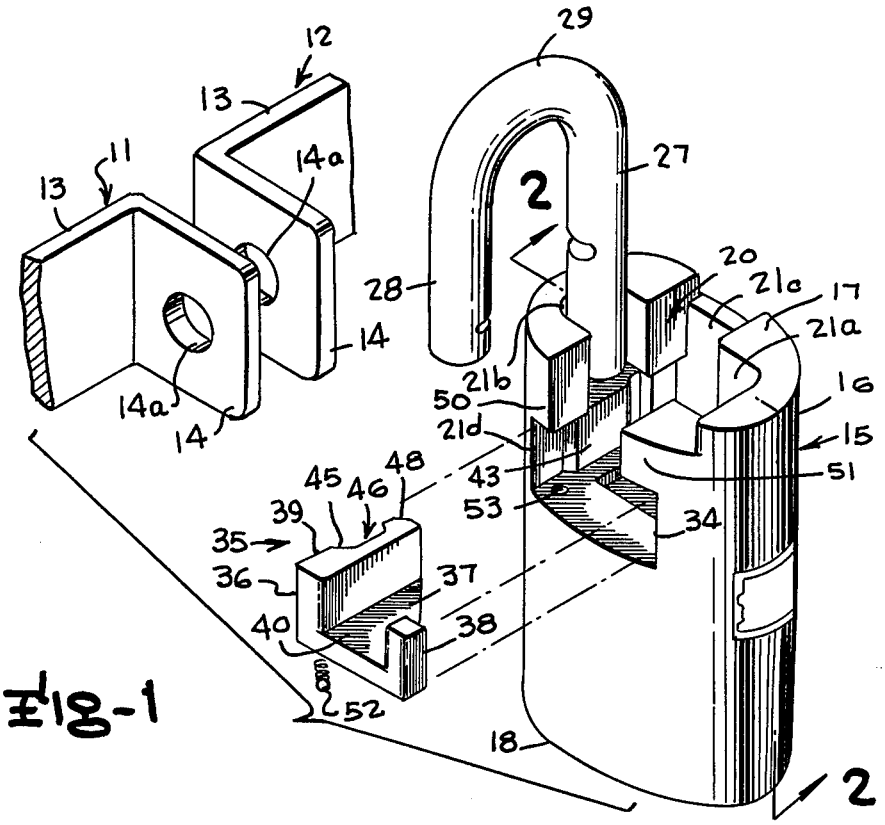
FIG. 1 is an exploded perspective view of a shrouded shackle padlock constructed in accordance with the present invention, with the shackle swung to open position and show adjacent a pair of L-shaped flange type locking bars with which the same is designed to be used.
Figure 2:
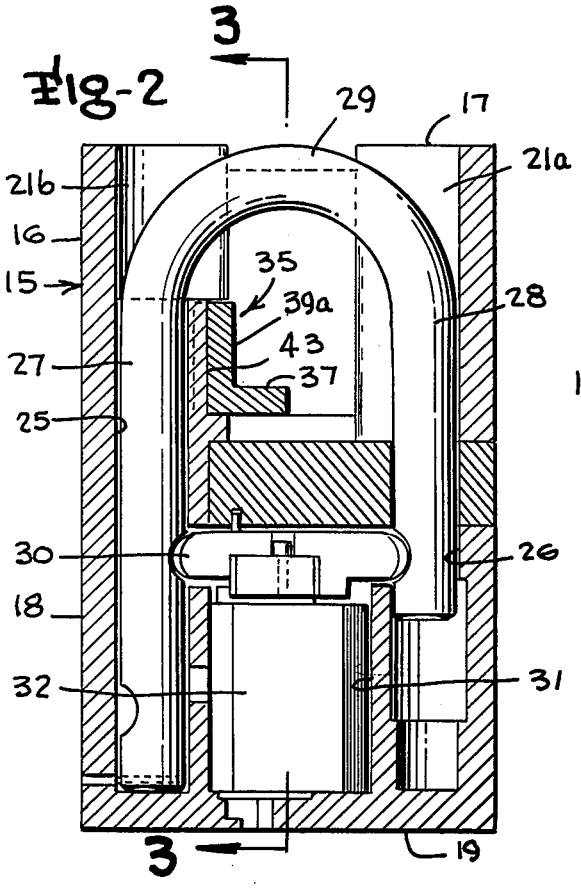
FIG. 2 is a vertical transverse section view of the padlock, taken along the transverse side-to-side axis along the line 2—2 of FIG. 1.
Figure 3:
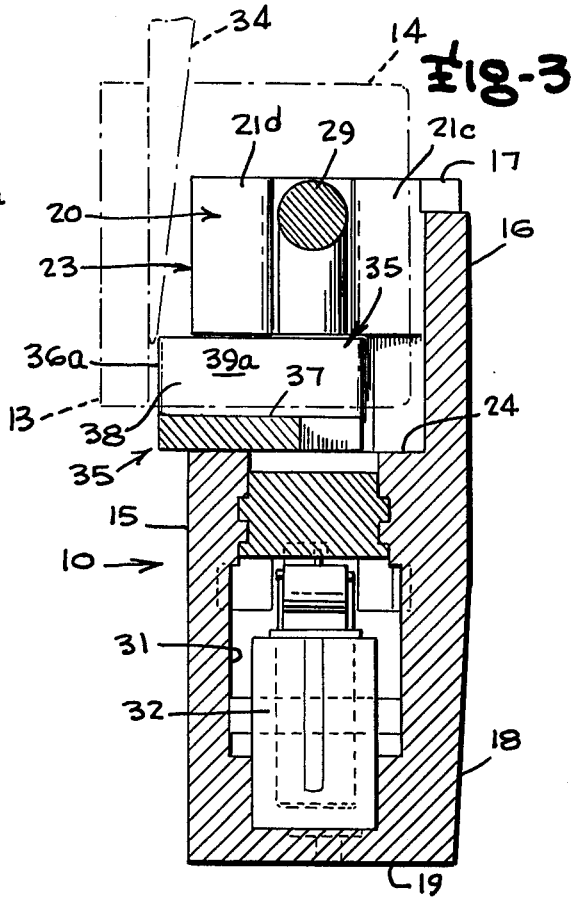
FIG. 3 is a vertical section view thereof taken along the fore and aft vertical plane indicated by the line 3—3 of FIG. 2, showing an attack driving wedge in broken lines positioned to begin attack on the lock.
Figure 4:
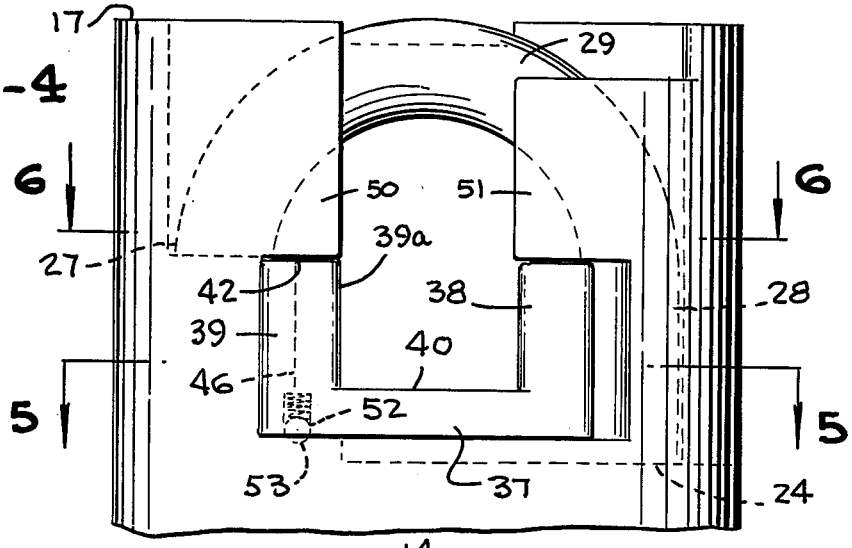
FIG. 4 is a fragmentary rear elevation view of the rear upper end portion of the padlock in the region of the rearwardly opening slot portion of the shackle and locking bar flange recess, to enlarged scale, showing one form of the anti-wedge mechanism of the present invention.

Referring to the drawings, wherein like reference characters designate corresponding parts throughout the several figures, there is illustrated in FIGS. 1, 2 and 3 a shrouded shackle padlock, indicated generally by the reference character 10, embodying the construction of the present invention and designed to be used with a pair of locking bars 11, 12 of the L-shaped flange type. The locking bars, as illustrated, are of L-shaped steel plates having a flat foot or base mounting portion 13 adapted to be secured by tamper-proof screws, not shown, to mounting surfaces, for example the forwardly facing adjacent surface portions near the meeting edge of a pair of sliding doors, and having at the ends of the mounting foot or base portions 13 which are nearest each other outwardly projecting flanges 14 which are of rectangular or near rectangular profile, forming heavy apertured staple formations, or what may be called locking ears or loops 14 designed to be abutted in side-by-side registered relation when the doors are closed to be secured tightly together in that condition. In this manner, the locking ears or staple formations 14, which will be hereinafter referred to as staple forming flanges project outwardly substantially perpendicular to the mounting surfaces of the doors to which they are secured. It will be appreciated, of course, that the base or foot portions 13 of the bars may be of other configurations than that shown in the drawings, and may, for one of the locking bars, extend rearwardly in the same plane as the outwardly projecting staple forming flange 14 of that locking bar, where it is desired to mount that locking bar on the face of a door jamb or frame surrounding the door opening and lying perpendicular to the front face of the door, in which case that locking bar serves as a conventional keeper. In either case, the staple forming flange 14 of the locking bar 12, whether it is an L-shaped angle member or a flat plate member, is designed to be disposed in laterally alined registering abutment with the staple forming flange 14 of the companion locking bar 11 in the locked condition.

The padlock body 15 of the shrouded shackle padlock herein illustrated is of generally elliptical configuration in top plan view, having an upper end portion 16 terminating in a top surface 17 and having a lower end portion 18 terminating in a bottom surface 19. The padlock body 15 is preferably a unitary casted body, formed for example of hardened steel, and in the illustrated embodiment has an upwardly opening cruciform shaped recess 20 opening through the top surface 17 and extending through a predetermined height inwardly therefrom through the upper end portion 16 of the padlock body having lateral wings or recess extensions 21*a*, 21*b* extending in a first lateral or side-to-side plane defining the portion of the recess shaped and sized to accommodate the padlock shackle 22 and having a front wing or recess extension extending forwardly in a second fore and aft plane perpendicular to the first mentioned plane and a rearward extension forming a slot 21*d* opening through the rear of the upper end or shroud portion of the padlock body at the location indicated at 23 to define a recess for snuggly accommodating the staple forming flange portions 14 of the pair of locking bars 11 and 12 with the shackle 22 extending through the apertures 14*a*, 14*b* of the staple forming flanges 14. At the foot or bottom of the cruciform shaped recess 20, which forms a shackle and staple flange receiving recess, a shoulder formation or surface 24 is provided which is interrupted by a pair of closed bottom sockets or bores 25, 26 extending downwardly through the surface 24 for receiving the legs of the shackle 22.

The shackle 22 is preferably in the form of a U-shaped rod of hardened steel material having a longer shackle leg 27 and a shorter shackle leg 28. The longer shackle leg 27 passes through the circular entrance opening at the top of the socket in the intermediate surface 24 of the padlock body at the bottom of the recess 20 and extends a substantial distance within the padlock body 15 toward the bottom surface 19. The longer shackle leg 27 is permitted a selected amount of axial and rotary movement relative to the padlock body 15, but is normally restrained against withdrawal from the socket 25 by the usual restraining pin provided in the padlock body. The free end portion of the shorter shackle leg 28 enters through the circular entrance opening of the socket 26 in the platform surface 24 into the closed bottom socket 26, when the shackle is in locking position. By this construction, the shorter leg 28 of the shackle can be withdrawn a sufficient distance from the platform surface portion 24 of the padlock body to dispose its free end at or immediately above the level of the top surface 17 of the padlock body or of a slight recess provided therefor in the top surface, whereupon the shackle can be swung to an exposed position illustrated in FIG. 1. The U-shaped shackle 22 also comprises the usual curved intermediate or bridging portion 29 extending between the legs 27 and 28, which serves as the portion which engages the laterally alined abutting staple forming flanges 14 of the pair of locking bars 11, 12 in the locking position. The apertures 14*a*, 14*b* of the staple forming flange portions 14 of the locking bars are of a diameter closely approximating the diameter of the shackle and are adapted to register with each other to receive the shackle, so that when they are nested within the forward wing 21*c* and rearward slot portion 21*d* of the cruciform shaped recess 20, with the upwardly arching bridge portion 29 of the shackle extending through the alined locking bar apertures 14*a*, 14*b*, the locking bar flanges are securely held and protected against attack from the sides or the front.

The shackle legs 27 and 28, in accordance with usual practice, have confronting notches 27*a*, 28*a* located within the padlock body when the shackle is in the locking position and disposed to receive end portions of a rotatable locking bolt 30 of conventional construction, for example of the type disclosed in earlier U.S. Pat. No. 3,713,309 to Harry C. Miller. The padlock body 15 also includes a closed bottom lower central bore portion 31, in the illustrated embodiment, which communicates with the sockets 25 and 26 and is shaped and sized to accommodate a key lock plug 32, which may be of conventional construction, having the usual rotatable plug therein responsive to insertion of the proper key through a key opening in the bottom surface 19 of the padlock body to effect rotation of the bolt member 30 through a sufficient angle to withdraw its end portions from the confronting locking notches 27*a*, 27*b* in the shackle legs and release the shackle to be manually withdrawn outwardly of the padlock body parallel to the axis of the longer shackle leg and then rotated about that axis to shift the shackle to a position permitting it to be withdrawn from the staple forming flanges of the locking bars.

The locking bolt 30 and the mechanism by which it is operated from the rotatable plug of the key lock cylinder may be like the construction disclosed in the earlier Miller U.S. Pat. No. 3,713,309, and the padlock body may be provided with a closure seal of the slide type as disclosed in that patent or a closure seal of the rotatable type as disclosed in the companion Miller U.S. Pat. No. 3,710,613, to permit selective opening of the closure seal over the housing cavity for the key lock cylinder and replacement of the key lock cylinder in the manner described in either of those earlier patents.

It will be appreciated that locks of this construction may be forcibly driven off of the locking bars 11, 12 by inserting the sharp ends of heavy metal wedges directed downwardly, laterally or upwardly against the upper rear wall portions of the padlock body between the mounting base or foot portions 13 of the locking bars and the rear of the padlock body, and driving them by sledges or heavy hammering tools so as to exert great outward wedging forces against the padlock body and thereby tear the case hardened shackle 22 forwardly through the apertured locking ears or staple formations 14 nested within the recess portions 21*c*, 21 *d* of the cruciform recess 20. To resist destruction of the security of the padlock and locking bar assembly by such wedge destruction techniques, the padlock of the present invention is additionally provided with a special anti-wedge device, indicated generally by the reference character 35, which in the illustrated embodiment is of a type which we refer to as the "wedge" type, which is located in a suitable guide channel in the lock body to dispose portions of the anti-wedge device 35 in the path of attack of any lock removing wedges which one may attempt to insert between the padlock body and the base or foot portions of the locking bars to lend additional support to and exert greater holding action on the locking ear or staple formation portions 14 of the locking bars and further resist tearing of the shackle from the locking bars. In the illustrated embodiment, the anti-wedge device 35 is made in the form of a single unitary U-shaped collar or saddle member 36 which, in rear elevation, is of U-shaped configuration having a height approximating the distance from the bottom of the rearwardly opening entrance slot 21*d* of the padlock body recess for the locking bar staple formations 14 and the underside of the bridging portion or arched portion 29 of the padlock shackle 22. The integral collar or saddle shaped anti-wedge member 36 has a bottom wall portion 37 of slightly distorted triangular configuration having a short vertically extending side wall 38 at the rear corner at one side of the channel or saddle member 36, shown as the right hand side wall in FIG. 5, and a long side wall 39 at the other lateral edge of the collar or saddle member 36 especially shaped to define a guide and ramp portion for the anti-wedge device and extending to a forwardmost end of the channel member 36 located forwardly of the zone occupied by the shackle 22 but spaced rearwardly of the forwardmost end wall 21*e* of the cruciform recess extension 21*c* receiving the forward end portions of the locking bar staple formations 14. The side walls 38 and 39 and bottom wall 37 of the collar or saddle member 36 form an upwardly opening channel defining a channel recess 40 having a width corresponding very close to the width of the pair of locking bar staple formations 14 when they are in lateral abutment with each other and extend into the padlock recess 20, and the height of the channel recess 40 corresponds very closely to the distance from the bottom of the shackle openings 14*a*, 14*b* in the locking bar staple formations 14 to the bottom of the formation 14.

Figure 5:
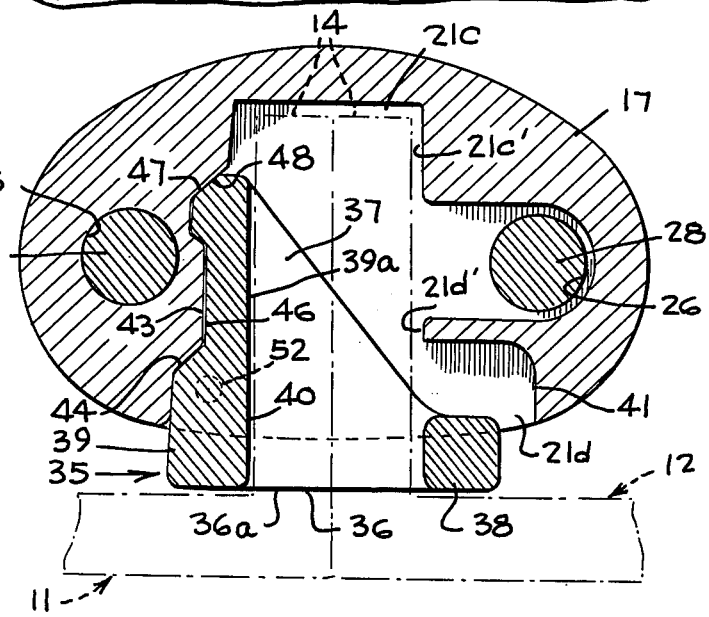
FIG. 5 is a horizontal section view taken along the line 5—5 of FIG. 3.
Figure 6:
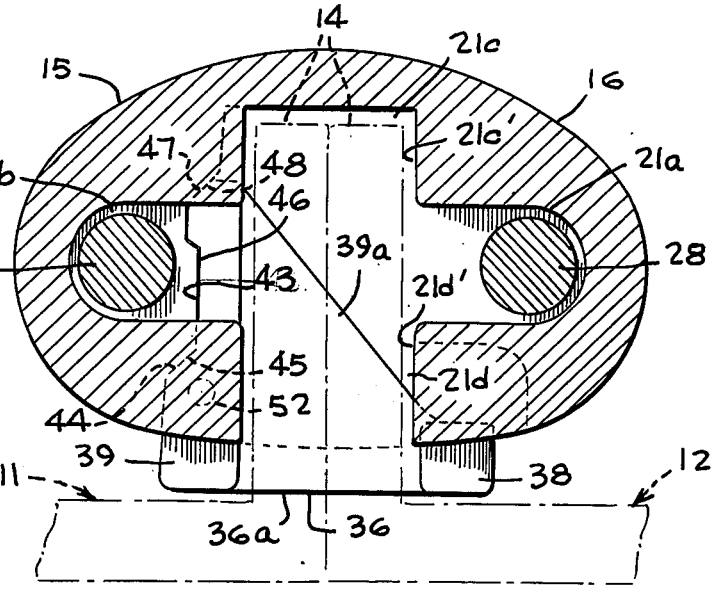
FIG. 6 is a fragmentary horizontal section view taken along the line 6—6 of FIG. 3.
Figure 7:
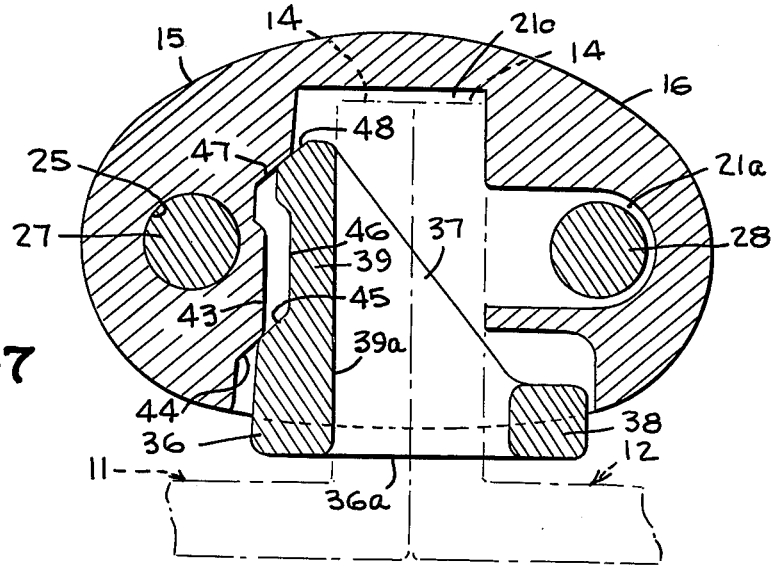
FIG. 7 is a fragmentary horizontal section view taken along the same section plane as FIG. 5, but showing the anti-wedge device in the position to which it is driven by a wedge during attack.

The corner of the padlock body portion laterally bounding the rearwardly opening entrance slot portion 21*d* of the padlock recess 21 nearest the short side wall 38 is cut away, as shown at 41 in FIG. 5, to accommodate the corner portion of the anti-wedge device 35 adjacent the short side wall 38 for a predetermined amount of forward movement inwardly of the padlock body recess 20. The opposite or longer side wall member 39 of the anti-wedge device 35 is fitted in a guide recess 42 therefor in the lateral bounding wall portion of the padlock body for the rearwardly opening entrance slot 21*d*. The lower portion of the vertical wall of the guide groove 42 is provided with a ramp forming rib 43 defining an inclined ramp surface 44 confronting inclined surface 45 forming the rearmost side wall of a vertical trough 46 in the outwardly facing surface of side wall 39, and the portion of the corresponding lateral bounding wall at the rearmost portion of the recess extension 21*c* of the cruciform recess 20 is similarly provided with a ramp surface 47 confronting an inclined surface 48 at the forwardmost portion of the outwardly facing surface of side wall 39. The anti-wedge device 35 is captured in the recess 20 by the bottom surface of the bottom wall 37 thereof abutting against the rearwardly opening cavity in the padlock body for slidably accommodating the anti-wedge device 35 and by the top surfaces of the side walls 38 and 39, which are of the same height, slidably bearing against downwardly facing confronting surfaces of the overhang formations 50 and 51 of the padlock body defining the lateral bounding surfaces of the entrance slot portion 21*d* of cruciform recess 20 between the top of the anti-wedge device 35 and the top surface 17 of the padlock body. The anti-wedge device 35 is restrained against accidental dislodgement from the cavity therefor formed in the cruciform recess 20 by any suitable detent means, such as by a spring loaded detent ball 52 formed in a drilled cylindrical socket therefor opening through the lower surface of the bottom wall portion 37 below the longer side wall portion 39, which is resiliently urged to releasably protrude into a spherical detent recess 53 in the confronting bottom wall portion of the cruciform recess 20. Alternatively, a frangible pin may be seated in a drilled socket therefor in the bottom wall portion 37 of the anti-wedge device, for example near the center of the bottom wall portion 37 lying between the adjacent surfaces of the side walls 38 and 39, which protrudes below the lower surface of the bottom wall 37 into a drilled socket or forwardly extending slot formed in the bottom surface of the cruciform recess 20 at an appropriate location to receive the downwardly protruding portion of the restraining frangible pin when the anti-wedge device 35 is located at the proper position.

It will be appreciated that with this construction, any attempt to forcibly wedge the padlock body off of the locking bars 11, 12 by the usual wedge attack techniques would cause the wedges, when driven between the rear wall portion of the padlock body and the closely adjacent forwardly facing surfaces of the locking bar mounting base portions 13 will bring the driving wedges into engagement with the rear surface 36*a* of the anti-wedge device 35 and, due to the relative angular dispositions of the rear and front ramp surfaces 44 and 47 and the confronting inclined surfaces 45 and 48 on the confronting padlock body portions causes the ramps to be accelerated into contact position relative to the inclined surfaces 45, 48 and movement of the anti-wedge device inwardly by the attack wedges causes it to climb the ramps 44 and 47 eliminating all clearances between the inwardly facing surface 39*a* of the anti-wedge device side wall 39 and the opposite confronting wall portion 21*c*′ and 21*d*′ of the cruciform recess extensions 21*c* and 21*d*, relative to the combined thickness of the laterally abutting and alined staple formations 14 of the locking bars. The effect of the driving of the anti-wedge device 35 forwardly relative to the padlock body by the driven attack wedges and the coaction of the ramp and inclined surfaces described above causes the anti-wedge device to progressively tighten the binding action between the surfaces 39*a*and surface portions 21*c*′ and 21*d*′ and the locking bar staple formations 14 to both reinforce the staple formations and more tightly grasp them against being torn from the cruciform recess 20 of the padlock body. If desired, the confronting surfaces of the portions of the cruciform recess bounding surfaces and the anti-wedge device surfaces which are forced into clamping action with the surfaces of the locking bar staple formations can be roughened by various treatment to further enhance the binding action, and can, if desired, be provided with saw tooth configurations, file-like roughened surfaces, or the like, to greatly enhance the holding action of the anti-wedge device 35 and padlock body on the locking bar staple formations 14.

Figure 8:
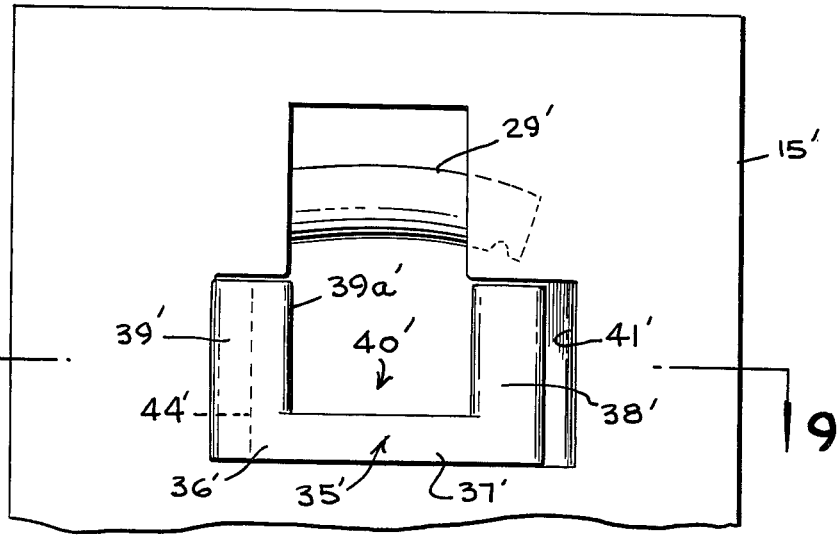
FIG. 8 is a fragmentary vertical rear elevation view similar to FIG. 4 showing the anti-wedge device of the present invention applied to a concealed shackle padlock construction.
Figure 9:
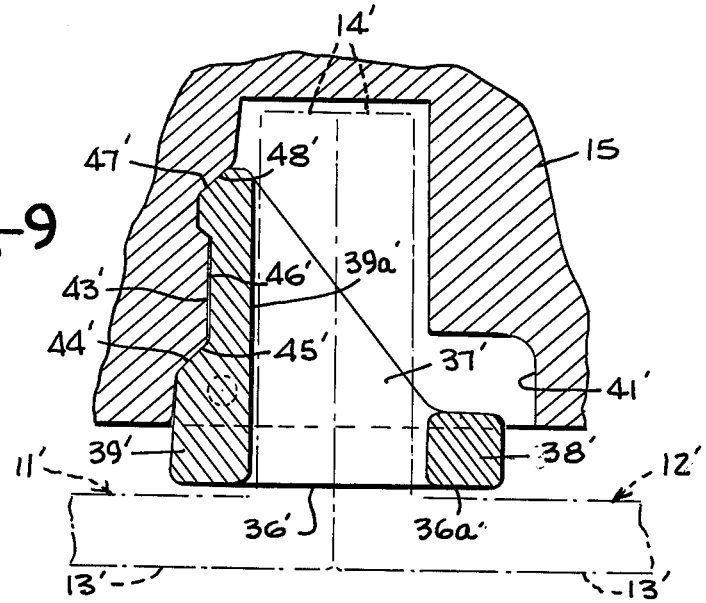
FIG. 9 is a fragmentary horizontal section view thereof taken along the line 9—9 of FIG. 8.

An alternate version is illustrated in FIGS. 8 and 9 in fragmentary form, wherein the anti-wedge device, here indicated by reference character 35′, is in the form of a channel or saddle member 36′ which extends alongside the bottom and lateral bounding wall portions of the rearwardly opening cavity 21′ of a concealed shackle padlock body 15′ to flank the opposite side portions of the pair of laterally alined abutting hasp portions 14′ of the locking bars 11′, 12′ to operate in the same fashion as the saddle member 36 of the first described embodiment. As in the first embodiment, the preferred embodiment herein illustrated for concealed shackle padlocks is of U-shaped configuration having a bottom portion 37′, a short vertical side wall 38′ and a longer side wall 39′ having ramp surfaces 45′ and 48′ coactive with ramp surfaces 44′ and 47′ on the confronting cavity side wall in the same manner as the perviously described embodiment. The concealed shackle padlock includes a bolt or shackle member 29′, which may be straight or curved, and which is actuated by usual bolt activating structure as known in the art in connection with previously available or publicly disclosed concealed shackle padlocks.

What is claimed is:

1. A high security padlock for securing in locked condition a pair of companion locking bars having ends providing apertured hasp portions to be locked together in parallel, laterally alined abutment, the padlock comprising a strong penetration and distortion resistant padlock body having a rearwardly opening cavity bounded by a pair of laterally spaced vertical bounding wall surfaces to receive the alined abutting hasp portions therebetween in enshrouded relation shielded by the padlock body against access by attacking tools directed from the front, sides, or bottom of the lock body, the padlock including a shackle having a portion movable from a locking position extending transversely through the cavity and through the apertures of the abutting hasp portions therein and a retracted position enabling withdrawal of the hasp portion from the cavity, a lock mechanism within the padlock body for locking the shackle in said locking position and releasing the same for movement to the retracted position; the improvement comprising a wedge-attack resisting collar member in said cavity for resisting destructive attack responsive to driving wedge-type attack tools in the zone located between the rear of the padlock and a rearwardly adjacent stationary surface of a portion of the locking bars or adjacent wall surface or the like by persons seeking destructive tearing of the padlock shackle forwardly through the hasp portions, the attack resisting collar member comprising integral bottom and side walls defining a hasp-receiving passage between the side walls to receive therethrough the laterally alined abutting hasp portions and one of said side walls providing a forwardly converging wedge portion located between the adjacent lateral surface of the adjacent hasp portion and the confronting bounding wall surface, said wedge portion having a contact surface adjacent the hasp portion and an opposite camming surface disposed adjacent and confronting the adjacent bounding wall surfaces, the collar member having a rear end portion projecting through said rearward opening for a predetermined distance beyond the rear of the lock body flanking the opposite sides of the alined abutting hasp portions into said zone to be engaged by the attacking tool when driven between the lock body and rearwardly adjacent surface, and said lock body having inclined ramp surface formations along the confronting bounding surface adjacent the wedge portion for imparting a predetermined component of lateral hasp gripping movement to the wedge portion toward the opposite bounding wall surface when the collar member is driven forwardly by the attacking tool and thereby bring portions of the padlock into increasingly tightening gripping engagement with the opposite lateral surfaces of said hasp portions for resisting destructive tearing and withdrawal of the hasp portions from the cavity.

2. A high security padlock as defined in claim 1, wherein the one of said side walls having said wedge portion and the other side wall are located respectively on opposite sides of the pair of laterally alined abutting hasp portions in the cavity between the adjacent lateral surfaces of the hasp portions and the confronting bounding wall surfaces of the cavity and each having their rear end portions projecting similar distances rearwardly beyond the rear surface of the lock body into the zone to be engaged by the attacking tool.

3. A high security padlock as defined in claim 2, wherein said other side wall extends forwardly only a short distance from the rear surface of the lock body for only a small fraction of the fore-and-aft length of the side wall having the wedge portion, said bottom wall converging forwardly in width from the short side wall to the forward end portion of the side wall having the wedge portion, and said cavity having a shallow corner recess at the side thereof adjacent the short side wall to receive the short side wall partially nested therein.

4. A high security padlock as defined in claim 1, wherein said wedge-attack resisting collar member is a generally channel-shaped saddle member having an upwardly opening U-shaped elevation from the rear thereof providing a pair of laterally spaced upwardly extending legs forming said side walls and separated by a distance closely conforming to the combined thickness of the alined abutting hasp portions, the upwardly extending legs defining an upwardly opening recess sized to receive the alined abutting hasp portions in forwardly projecting relation therethrough.

5. A high security padlock as defined in claim 2, wherein said wedge-attack resisting collar member is a generally channel-shaped saddle member having an upwardly opening U-shaped elevation from the rear thereof providing a pair of laterally spaced upwardly extending legs forming said side walls and separated by a distance closely conforming to the combined thickness of the alined abutting hasp portions, the upwardly extending legs defining an upwardly opening recess sized to receive the alined abutting hasp portions in forwardly projecting relation therethrough.

6. A high security padlock as defined in claim 3, wherein said wedge-attack resisting collar member is a generally channel-shaped saddle member having an upwardly opening U-shaped elevation from the rear thereof providing a pair of laterally spaced upwardly extending legs forming said side walls and separated by a distance closely conforming to the combined thickness of the alined abutting hasp portions, the upwardly extending legs defining an upwardly opening recess sized to receive the alined abutting hasp portions in forwardly projecting relation therethrough.

7. A high security padlock as defined in claim 1, including means for restraining the collar member against accidental dislodgement from the cavity including a restraint formation projecting from a surface of the collar member and the confronting bounding portion of the cavity having a recess therein for receiving said formation whereby the walls of said recess resist withdrawal of the collar member outwardly from the cavity from its normal position therein.

8. A high security padlock as defined in claim 2, including means for restraining each of said collar members against accidental dislodgement from the cavity including a restraint formation projecting from a surface of the collar member and the confronting bounding portion of the cavity having a recess therein for receiving said formation whereby the walls of said recess resist withdrawal of the collar member outwardly from the cavity from its normal position therein.

9. A high security padlock as defined in claim 4, including means for restraining the collar member against accidental dislodgement from the cavity including a restraint formation projecting from a surface of the collar member and the confronting bounding portion of the cavity having a recess therein for receiving said formation whereby the walls of said recess resist withdrawal of the collar member outwardly from the cavity from its normal position therein.

10. A high security padlock as defined in claim 1, wherein said inclined ramp surface formations on the bounding surface of the lock body adjacent the wedge portion comprises a firsrt vertically elongated ramp surface near the forwardmost edge of the wedge portion and a second ramp surface spaced rearwardly therefrom respectively adjacent a pair of inclined surface formations on the wedge portion forming said camming surface.

11. A high security padlock as defined in claim 4, wherein said inclined ramp surface formations on the bounding surface of the lock body adjacent the wedge portion comprises a first vertically elongated ramp surface near the forwardmost edge of the wedge portion and a second ramp surface spaced rearwardly therefrom respectively adjacent a pair of inclined surface formations on the wedge portion forming said camming surface.

12. A high security padlock as defined in claim 9, wherein said inclined ramp surface formations on the bounding surface of the lock body adjacent the wedge portion comprises a first vertically elongated ramp surface near the forwardmost edge of the wedge portion and a second ramp surface spaced rearwardly therefrom respectively adjacent a pair of inclined surface formations on the wedge portion forming said camming surface.

13. A high security padlock as defined in claim 1, wherein said padlock body is in the form of a shrouded shackle padlock having a cruciform shaped recess opening through the top of the padlock body for receiving the padlock shackle and the alined abutting hasp portions therein, the padlock shackle being of the U-shaped shackle type having a pair of laterally spaced shackle legs and an upwardly arching bridge portion to extend through the hasp portion apertures, and said cruciform shaped recess having a pair of laterally extending wings defining a first laterally elongated recess dimensioned to correspond substantially to the maximum distance between the outer edge portions of the shackle legs and the cruciform shaped recess having forward and rearward extensions defining a second recess elongated in a fore and aft direction and opening rearwardly through the padlock body dimensioned to closely correspond to the combined transverse thickness of the abutting laterally alined hasp portions and the major portion of said collar member for receiving the same in said cavity.

14. A high security padlock as defined in claim 4, wherein said padlock body is in the form of a shrouded shackle padlock having a cruciform shaped recess opening through the top of the padlock body for receiving the padlock shackle and the alined abutting hasp portions therein, the padlock shackle being of the U-shaped shackle type having a pair of laterally spaced shackle legs and an upwardly arching bridge portion to extend through the hasp portion apertures, and said cruciform shaped recess having a pair of laterally extending wings defining a first laterally elongated recess dimensioned to correspond substantially to the maximum distance between the outer edge portions of the shackle legs and the cruciform shaped recess having forward and rearward extensions defining a second recess elongated in a fore and aft direction and opening rearwardly through the padlock body dimensioned to closely correspond to the combined transverse thickness of the abutting laterally alined hasp portions and the major portion of said collar member for receiving the same in said cavity.

15. A high security padlock for securing in locked condition a pair of companion locking bars having ends providing apertured hasp portions to be locked together in parallel, laterally alined abutment, the padlock comprising a strong penetration and distortion resistant padlock body having a rearwardly opening cavity bounded by a pair of laterally spaced vertical bounding wall surfaces to receive the alined abutting hasp portions therebetween in enshrouded relation shielded by the padlock body against access by attacking tools directed from the front, sides, or bottom of the lock body, the padlock including a shackle having a portion movable from a locking position extending transversely through the cavity and through the apertures of the abutting hasp portions therein and a retracted position enabling withdrawal of the hasp portion from the cavity, a lock mechanism within the padlock body for locking the shackle in said locking position and releasing the same for movement to the retracted position; the improvement comprising a wedge-attack resisting collar member in said cavity adapted to surround three sides of the pair of laterally alined abutting hasp portions at the rear of the lock body for resisting destructive attack by wedge-type attack tools in the zone driven against the rear of the padlock by persons seeking destructive tearing fo the padlock shackle forwardly through the hasp portions, the attack resisting collar member comprising said walls defining a hasp-receiving passage therebetween to receive therethrough the laterally alined abutting hasp portions and one of said side walls having a forwardly converging wedge means located between the adjacent hasp portion and the confronting bounding wall surface, the collar member having a rear end portion projecting through said rearward opening for a predetermined distance beyond the rear of the lock body flanking the opposite sides of the alined abutting hasp portions into said zone to be engaged by the attacking tool when driven against the rear of the lock body and the confronting bounding surface adjacent the wedge means having inclined ramp surface means coactive with inclined surfaces of said wedge means for imparting a predetermined component of lateral hasp gripping movement to the collar member toward the opposite bounding wall surface when the collar member is driven forwardly by the attacking tool and thereby bring surfaces of the collar member and cavity into increasingly tightening gripping engagement with the opposite lateral surfaces of said hasp portions for resisting destructive tearing and withdrawal of the hasp portions from the cavity.

* * * * *